United States Patent [19]

Wharrie

[11] 4,306,374

[45] Dec. 22, 1981

[54] ELECTRICAL SAFETY PLUG AND SOCKET COMBINATION

[75] Inventor: Raymond Wharrie, Lyndhurst, N.J.

[73] Assignee: Durham Industries, Inc., New York, N.Y.

[21] Appl. No.: 88,855

[22] Filed: Oct. 29, 1979

[51] Int. Cl.[3] ..... H01R 13/64; H01R 13/642

[52] U.S. Cl. ..... 46/33; 339/184 R

[58] Field of Search ..... 339/47 R, 49 R, 66 R, 339/66 M, 91 R, 184 R, 184 M, 185 R, 186 R, 186 M; 46/33; 179/1 PC

[56] References Cited

U.S. PATENT DOCUMENTS

| | | | |
|---|---|---|---|
| 2,510,944 | 6/1950 | Averbach | 339/66 M |
| 2,828,474 | 3/1958 | Fox | 339/185 R |
| 3,089,071 | 5/1963 | Hartwig | 339/184 R |
| 3,588,784 | 6/1971 | Kunkle | 339/184 M |

*Primary Examiner*—Neil Abrams

*Attorney, Agent, or Firm*—Michael Ebert

[57] ABSTRACT

An electrical safety plug having two prongs receivable in a complementary socket having two terminal holes, the plug and socket combination being polarized so that the relationship between the prongs and terminals is non-reversible. The plug body has integral therewith a safety tab so positioned that when the plug is correctly inserted in the socket, the tab lies under the body of the socket. The tab blocks insertion when the user seeks to make an incorrect insertion in the complementary socket or in the event the user tries to plug into any other socket.

1 Claim, 8 Drawing Figures

ELECTRICAL SAFETY PLUG AND SOCKET COMBINATION

INTRODUCTION

1. Field of Invention

This invention relates generally to electrical male plugs which are receivable in female sockets to effect a connection between the plug line and the socket terminals, and more particularly to a safety plug which is insertable in a complementary socket but cannot be plugged into any other receptacle such as a socket carrying high voltage power, the relationship of the plug and socket being non-reversible.

2. Background of Invention

In certain toys intended for the pre-school market—that is, for children of less than 5 years of age—use is made of electrical line plugs which carry a low voltage.

Thus toy telephone systems are known which are made up of two battery-operated telephone sets that are interconnected by a detachable extension line. Each set is provided with a two-terminal socket, the link between these sockets being effected by two-prong plugs inserted therein, the plugs being at the respective ends of the extension line. When the two sets are interconnected in this manner, two children can ring each other and communicate over a distance limited by the length of the extension line.

Two-prong plugs of the type suitable for this purpose are designed for low-voltage electrically-energized toys operated by flashlight batteries, the voltage level being well below the point where it is in any way hazardous to children. However, in the hands of a playful child, these plugs could be dangerous; for a child may decide to insert the plug in a wall outlet socket carrying high-voltage power.

While the two-prong plug is not designed for power outlet sockets, by manipulating the prongs it may be possible to force them into such sockets, thereby exposing the child to the danger of a serious electrical shock.

Many attempts have heretofore been made to render electrical plugs inoperative under certain circumstances so that they cannot be plugged into a socket. Thus the Libordi U.S. Pat. No. 3,781,913 and the Husebo U.S. Pat. No. 3,422,389 both show safety blocks which are attachable to the prongs of a male plug to prevent the insertion thereof. But such safety blocks are not feasible for toy plugs in that they would require parental supervision to be sure that the plugs were blocked except when put to use on the toy.

The Teetor U.S. Pat. No. 2,759,195 takes another approach to safety by providing a plug with a retractable safety rod as well as two standard prongs. But this safety plug entails a special key to operate the safety rod, and this too would dictate parental intervention.

The Heller U.S. Pat. No. 2,764,748 is of greater relevance; for Heller is specifically concerned with electrical plugs intended for electrically-operated toys. To render the plug effective only for use with a complementary socket in the toy, Heller equips his two prong plug with a safety lug. In order to receive this plug, Heller provides a special socket with three openings, two being terminal openings to receive the metal springs and to make a connection therewith, and the third to accommodate the safety lug. Hence the Heller plug can be inserted in a special three-hold socket but not in a standard two-hole socket, for the safety lug would block such insertion.

Another factor involved in toy plug and socket combinations is polarity. When the combination is intended for d-c power connections, it is vital that the polarity of the circuit be maintained so that the positive side of the power supply is always connected to the positive terminal of the circuit energized thereby. But the typical plug, such as those used in a-c installations, is reversible; hence when used in direct-current applications, the circuit will be disabled if the polarities are reversed.

SUMMARY OF INVENTION

In view of the foregoing, the main object of this invention is to provide a two-prong electrical plug which is insertable in a complementary two-hole terminal socket carrying a low voltage, but cannot be inserted into any other two-hole socket whereby the plug can be safely used by children without fear of misuse and the danger of electrical shock.

More particularly, it is an object of this invention to provide a safety plug and complementary socket combination, the plug including a safety tab that serves to restrict insertion of the plug to its complementary socket, the tab acting as an insertion guide for this purpose.

Also another object of the invention is to provide a polarized plug and socket combination for use in connection with direct-current circuits, the plug being insertable in the socket in a manner connecting positive to positive and negative to negative, a reversed relation being interdicted.

Yet another object is to provide a safety plug and socket combination of the above type which operates reliably and efficiently and which can be manufactured at low cost.

Briefly stated, these objects are attained in an electrical plug and complementary socket combination, the plug being insertable in one polar direction only in this socket and in no other socket.

The plug is constituted by an insulation body having an integral base tab extending forwardly from the front end of the body, first and second flat metal prongs at right angles to each other being embedded at spaced positions within the body and extending from the front end thereof, the prongs being connectable to a line carrying a direct current.

The complementary socket is constituted by a housing whose configuration is such that when the plug is correctly coupled thereto, the safety tab lies under the body, the socket body having holes which register with the prongs of the plug. Held within the holes are first and second flat metal terminals at right angles to each other in planes which are normal to the planes of the corresponding prongs. Each terminal is formed to define a pair of resilient tines whereby when the prongs are inserted in the holes, the tines are deflected to grip the inserted prongs, thereby effecting a good connection therewith.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
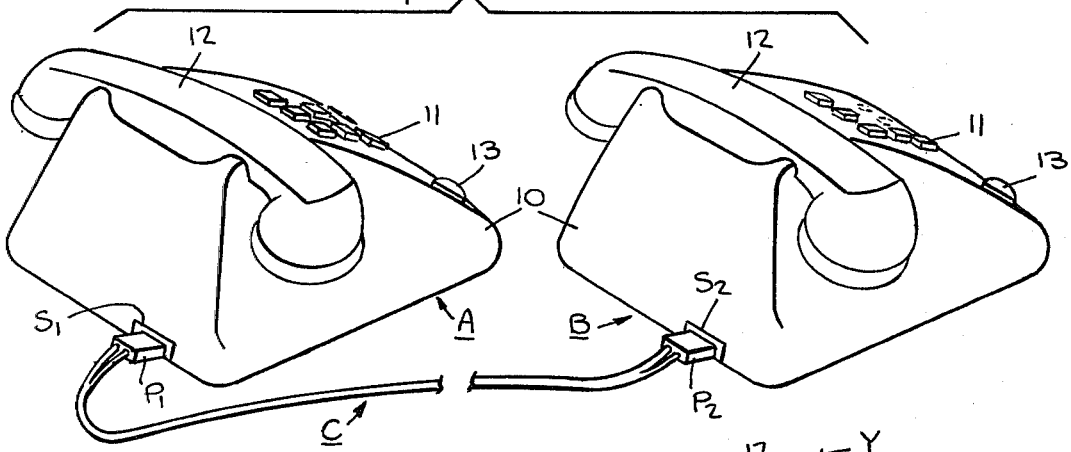
FIG. 1 illustrates a toy constituted by two telephone sets each having a socket which is adapted to receive plugs in accordance with the invention that are connected to the ends of the extension line linking the two sets.

Referring now to FIG. 1, there is shown a toy which incorporates a plug and complementary socket combination in accordance with the invention, the toy being in the form of a pair of identical telephone sets A and B which are linked together by an extension line C.

Each set includes a housing 10 having a keyboard 11 for dialing, and a receiver-transmitter hand piece 12, so that a child operating one set may ring a child operating the other set and communicate with him over a distance limited by the length of line C. Contained in housing 10 are batteries which provide the required d-c power for the toy. A flashing light 13 on the housing accompanies a ringing action.

The concern of the present invention is with the plug and complementary socket combination which makes it possible to detachably connect line C to the operating circuits of each set, the line carrying direct-current signals. While the plug and socket combination is illustrated herein in the context of a toy telephone communication system, it will be appreciated that the same combination is useful in conjunction with any battery-powered toy which requires a connecting link for conveying d-c signals in a predetermined polarity.

Two-wire line C is terminated at either end by plugs $P_1$ and $P_2$, plug $P_1$ being insertable in socket $S_1$ of telephone set A and plug $P_2$ being insertable in socket $S_2$ of telephone set B. The sets are interconnected and operated only when the plugs are properly received in the sockets.

Figure 2:
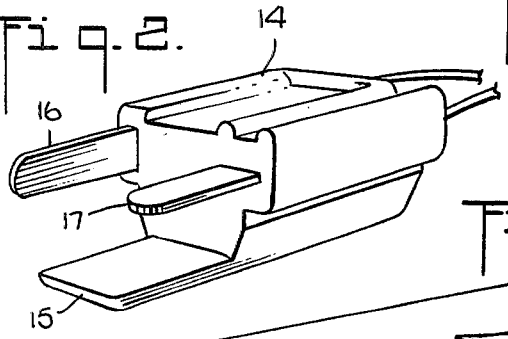
FIG. 2 is a perspective view of one of the plugs as seen from the front face.
Figure 3:
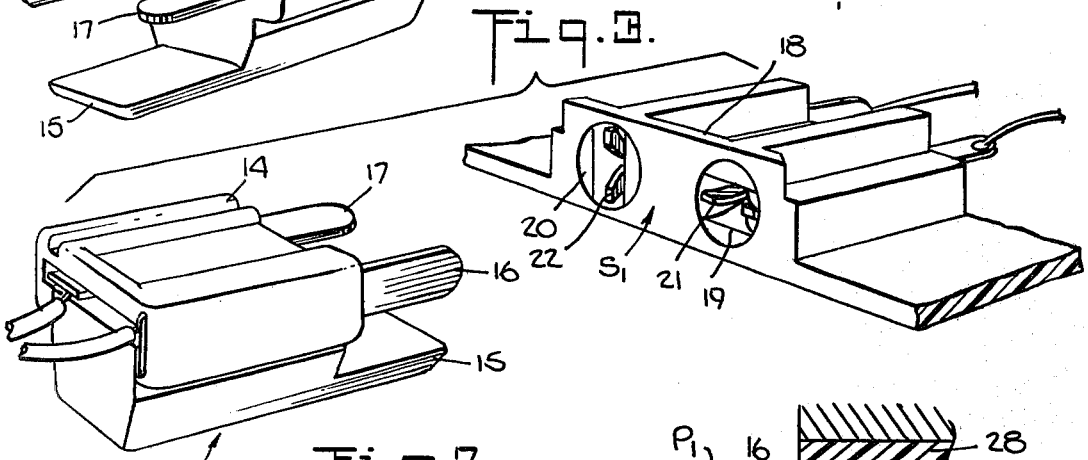
FIG. 3 is a perspective view of the plug as seen from the rear face in its relation to the complementary socket.

Each plug, as best seen in FIGS. 2 and 3, comprises an insulating body 14 molded of polyvinyl chloride or other suitable plastic material having good electrical insulating and structural properties, the front end of this body having an integral base tab 15 extending forwardly therefrom. Embedded in body 14 at spaced positions therein are first and second flat metal prongs 16 and 17, these prongs projecting forwardly from the plug to the same extent as base tab 15. The prongs are fabricated of bronze or other highly-conductive metal alloy.

Figure 4:
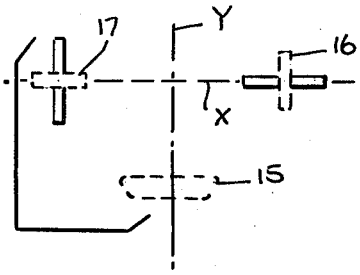
FIG. 4 illustrates the geometric relationship between the prongs and tabs of the plugs.

The geometric relationship between tab 15 and prongs 16 and 17 is illustrated in FIG. 4 where it will be seen that the plane X in which prongs 17 lies, passes through the midpoint of prong 16 and is at right angles thereto, plane X being parallel to tab 15. Plane Y which is parallel to the plane of prong 16 is at right angles to the plane of tab 15 and passes through the midpoint of the tab.

Figure 5:
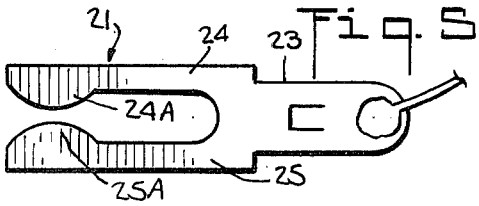
FIG. 5 is a plan view of one of the socket terminals.

The sockets which complement the plugs are constituted, as shown in FIG. 3, by a housing 18 of insulating material having two holes 19 and 20 therein which are accessible from the front end of the housing. Held within hole 19 is a first flat metal terminal 21, and within hole 20 is an identical flat metal terminal 22. Each terminal, as shown in FIG. 5, is formed by a lug 23 to which a wire is connectable and a pair of resilient tines 24 and 25 having contoured tips 24A and 25A which normally are closed to each other or abut.

Figure 6:
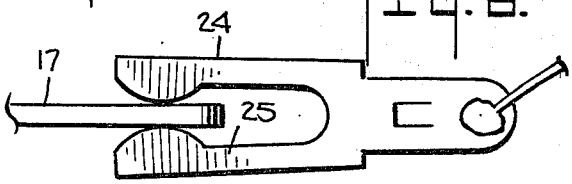
FIG. 6 shows the manner in which a plug prong engages a socket terminal.

When, as shown in FIG. 6, a flat metal prong 17 whose plane is at right angles to the plane of the socket terminal is introduced between the tines of the terminal, the tines are deflected thereby and grip onto the prong to make a good electrical connection therewith.

Thus the geometric relationship of the terminals 21 and 22 of the socket is the reverse of that in the prongs, the plane of first terminal 21 being normal to that of the first prong 16, and the plane of the second terminal 22 being normal to that of the second prong 17. Thus it is possible to insert the plug into the complementary socket in one direction only, the arrangement being non-reversible.

Figure 7:
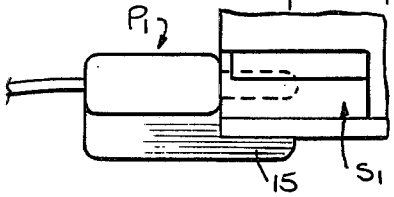
FIG. 7 shows the physical relationship of the plug to the socket when the plug is inserted therein.

The physical relationship of the plug tab to the socket is shown in FIG. 7, where it will be seen that when the plug is correctly inserted, the tab passes under the base of the socket and lies thereagainst. Thus in the plug and complementary socket combination, tab 15 acts as a guide for the plug. Should the user try to insert the plug in the reverse direction—that is, with the planes of the flat prongs in the same planes as the flat terminals—then the tab, instead of passing under the socket, will strike the front end of the socket and frustrate this attempt. Thus the tab assures correct insertion of the plug, for the plug can only be inserted in the proper polar direction.

Figure 8:
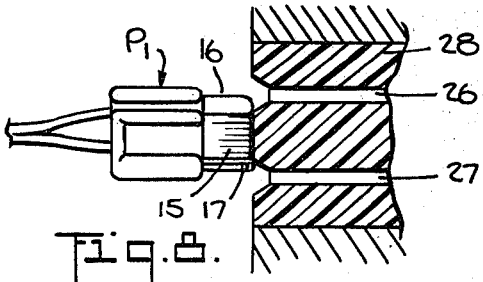
FIG. 8 shows the relationship of the plug to a non-complementary socket when an attempt at insertion is made.

The tab also acts as a safety device; for, as shown in FIG. 8, should the user seek to force prongs 16 and 17 of the plug in the receptacle holes 26 and 27 of a standard wall outlet socket 28 carrying high voltage power, tab 15 will prevent such insertion. In this instance, the tab will strike the outer plate of the outlet intermediate the receptacle holes and prevent insertion of the plug, thereby avoiding any danger of electrical shock.

While there has been shown and described a preferred embodiment of an electrical safety plug and socket combination in accordance with the invention, it will be appreciated that many changes and modifications may be made therein without, however, departing from the essential spirit thereof.

I claim:

1. In the combination of a plug and a battery-operated toy telephone set having a base and a socket positioned at the bottom of said base, an electrical line plug for effecting a connection between a line and a complementary socket whose terminals are connected to an electrically-active direct-current circuit whereby the line carries a d-c signal, the combination comprising:

A said plug having a body of insulating material whose base has integral therewith a flat tab which extends forwardly from the front end of the body, and first and second flat metal prongs embedded in the body at spaced positions therein and projecting from the front end thereof, said projecting prongs having the same length as the tab, the position of the tab being intermediate that of the prongs;

B said socket having a housing including a flat underside and provided with two holes at positions in registration with the prongs, the tab lying under the housing against the underside thereof and under the toy telephone base when the plug is correctly inserted, and first and second flat metal terminals held in the respective holes, each terminal having a pair of resilient tines which are deflected when a prong is inserted therein to grip the prong and a connecting lug integral with the tines, said tab having a length preventing even partial insertion of the plug in any other socket having two holes, the plane of the first prong passing through the midpoint of the second prong and being at right angles to the plane thereof, the first plane being parallel to the plane of the tab, the geometric relationship of the terminals in the socket being the reverse of that of the prongs, whereby the plug may be inserted in the socket in one direction only and is non-reversible, the line connecting a pair of such telephone sets.

* * * * *